US009734749B2

(12) United States Patent
Hwang et al.

(10) Patent No.: US 9,734,749 B2
(45) Date of Patent: Aug. 15, 2017

(54) IMAGE DISPLAY METHOD, IMAGE DISPLAY DEVICE AND DISPLAY APPARATUS FOR PENTILE DISPLAY PANEL

(71) Applicant: SHENZHEN CHINA STAR OPTOELECTRONICS TECHNOLOGY CO., LTD., Shenzhen, Guangdong (CN)

(72) Inventors: Tai-Jiun Hwang, Guangdong (CN); Pengfei Liang, Guangdong (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 8 days.

(21) Appl. No.: 14/417,692

(22) PCT Filed: Dec. 22, 2014

(86) PCT No.: PCT/CN2014/094473
§ 371 (c)(1),
(2) Date: Jan. 27, 2015

(87) PCT Pub. No.: WO2016/095239
PCT Pub. Date: Jun. 23, 2016

(65) Prior Publication Data

US 2016/0180765 A1 Jun. 23, 2016

(30) Foreign Application Priority Data

Dec. 17, 2014 (CN) ..... 2014 1 0784103

(51) Int. Cl.
*G09G 3/36* (2006.01)
*G09G 3/30* (2006.01)
(Continued)

(52) U.S. Cl.
CPC ..... *G09G 3/2074* (2013.01); *G09G 3/20* (2013.01); *G09G 3/3208* (2013.01);
(Continued)

(58) Field of Classification Search
CPC ..... G09G 3/20; G09G 3/2074; G09G 3/3208; G09G 3/3688; G09G 3/2003
See application file for complete search history.

(56) References Cited

U.S. PATENT DOCUMENTS 7,495,679 B2 * 2/2009 Chou ..... H04N 9/69 345/690
2005/0063015 A1 3/2005 Kakutani
(Continued)

FOREIGN PATENT DOCUMENTS

CN 102187267 A 9/2011
CN 103035191 A 4/2013
(Continued)

*Primary Examiner* — Kwang-Su Yang
(74) *Attorney, Agent, or Firm* — Muncy, Geissler, Olds & Lowe, P.C.

(57) ABSTRACT

The present invention provides an image display method, comprising: acquiring test gray scale data for pixel data of test image data, and acquiring the gray scale compensation table according to the test gray scale data and the preset gray scale data; converting the original image data into processed image data; implementing gray scale data compensation to pixel data in the processed image data according to a gray scale compensation table; implementing display operation with the processed image data after the gray scale data compensation.

4 Claims, 3 Drawing Sheets

(51) Int. Cl.
*G09G 3/20* (2006.01)
*G09G 3/3208* (2016.01)

(52) U.S. Cl.
CPC ... *G09G 3/3611* (2013.01); *G09G 2300/0439* (2013.01); *G09G 2320/0233* (2013.01); *G09G 2320/0257* (2013.01); *G09G 2320/0285* (2013.01); *G09G 2320/0666* (2013.01)

(56) References Cited

U.S. PATENT DOCUMENTS

| | | | | |
|---|---|---|---|---|
| 2009/0175558 | A1 | 7/2009 | Moriya et al. | |
| 2011/0181627 | A1* | 7/2011 | You | G09G 3/3406 345/690 |
| 2013/0083094 | A1* | 4/2013 | Park | G09G 3/2003 345/690 |
| 2013/0088528 | A1 | 4/2013 | Borgers | |
| 2013/0222438 | A1 | 8/2013 | Shin | |
| 2014/0176617 | A1 | 6/2014 | Jeong et al. | |
| 2014/0184671 | A1 | 7/2014 | Lee | |
| 2016/0042711 | A1* | 2/2016 | Kim | G09G 3/3688 345/691 |

FOREIGN PATENT DOCUMENTS

| | | | |
|---|---|---|---|
| CN | 103886829 | A | 6/2014 |
| JP | 2004350257 | A | 12/2004 |
| JP | 2009188982 | A | 8/2009 |
| KR | 20130097466 | A | 9/2013 |

* cited by examiner

IMAGE DISPLAY METHOD, IMAGE DISPLAY DEVICE AND DISPLAY APPARATUS FOR PENTILE DISPLAY PANEL

FIELD OF THE INVENTION

The present invention relates to a display technology field, and more particularly to an image display method, an image display device and a display element.

BACKGROUND OF THE INVENTION

The present display panel has a regular pixel alignment and a particular pixel alignment (such as gentile alignment), and the way that the inputted image is shown on the display by independent pixel display is the regular pixel alignment, i.e. no pixel sharing condition occurs, and the way that the inputted image is shown on the display by sharing pixel display is the particular pixel alignment.

The uneven brightness phenomena often occurring in the present display panel are all called as display Mura. For now, only the method for solving the uneven display of the panels of regular pixel alignment exists. Because the pixel sharing exists in the panels of particular pixel alignment, it cannot be ensured that the abnormal gray scale value of which pixel specifically causes the position of uneven display. The present solution for the uneven display cannot deal with the panels of particular pixel alignment.

Consequently, there is a need to provide an image display method, an image display device and a display apparatus for solving the existing issue of the prior art.

SUMMARY OF THE INVENTION

An objective of the present invention is to provide an image display method, an image display device and a display apparatus, for solving the technical issue that the prior art cannot deal the uneven display of the panel with special pixel arrangement.

For solving the aforesaid issue, the present invention provides an image display method, comprising: inputting original image data, wherein the original image data is employed to implement sharing pixel display on a display panel; wherein a pixel of the display panel comprises a red sub pixel, a green sub pixel, a blue sub pixel, a white sub pixel;

converting the original image data into processed image data, wherein the processed image data is employed to implement independent pixel display on the display panel;

implementing gray scale data compensation to pixel data in the processed image data according to a gray scale compensation table; and implementing display operation on the display panel with the processed image data after the gray scale data compensation;

wherein the gray scale data compensation table is generated by steps of:

acquiring test gray scale data under a plurality of various preset grey scales for pixel data of test image data, and respectively acquiring test gray scale data under the same preset grey scale for each kind of pixel data of test image data, wherein the test image data is employed to implement independent pixel display on the display panel; and acquiring the gray scale compensation table according to the test gray scale data and the preset gray scale data.

In the image display method of the present invention, the step of implementing gray scale data compensation to pixel data in the processed image data according to a gray scale compensation table comprises:

acquiring first gray scale data of pixel data in the processed image data;

acquiring gray scale compensation values corresponded with the first gray scale data from the first gray scale data and the gray scale compensation table via a preset rule; and implementing compensation to the first gray scale data of pixel data in the processed image data according to the gray scale compensation values.

In the image display method of the present invention, after the step of acquiring the gray scale compensation values corresponded with the first gray scale data, the method further comprises: storing the gray scale compensation values corresponded with the first gray scale data.

In the image display method of the present invention, the pixel of the display panel further comprises a yellow sub pixel.

The present invention further provides an image display device, the device comprises: an inputting module, employed for inputting original image data, wherein the original image data is employed to implement sharing pixel display on a display panel;

a converting module, employed for converting the original image data inputted by the inputting module into processed image data, wherein the processed image data is employed to implement independent pixel display on the display panel;

a compensating module, employed for implementing gray scale data compensation to pixel data in the processed image data according to a gray scale compensation table acquired by a compensation table acquiring unit; and a display module, employed for implementing display operation on the display panel with the processed image data after the gray scale data compensation;

wherein the compensating module further comprises:

a test gray scale acquiring unit, employed for acquiring test gray scale data under a plurality of various preset grey scales for pixel data of test image data, wherein the test image data is employed to implement independent pixel display on the display panel; and the compensation table acquiring unit, employed for acquiring the gray scale compensation table according to the test gray scale data and the preset gray scale data acquired by the test gray scale acquiring unit.

In the image display device of the present invention, the test gray scale acquiring unit is further employed for respectively acquiring test gray scale data under the same preset grey scale for each kind of pixel data of test image data.

In the image display device of the present invention, the compensating module further comprises:

a first gray scale data acquiring unit, employed for acquiring first gray scale data of pixel data in the processed image data;

gray scale compensation value acquiring unit, employed for acquiring gray scale compensation values corresponded with the first gray scale data acquired by the first gray scale data acquiring unit from the first gray scale data and the gray scale compensation table via a preset rule; and gray scale compensation value compensating unit, employed for implementing compensation to the first gray scale data of pixel data in the processed image data according to the gray scale compensation values acquired by the gray scale compensation value acquiring unit.

In the image display device of the present invention, the compensating module further comprises a storage unit, and the storage unit is employed for storing the gray scale compensation values corresponded with the first gray scale data after gray scale compensation value acquiring unit acquires gray scale compensation values corresponded with the first gray scale data.

In the image display device of the present invention, the pixel of the display panel comprises a red sub pixel, a green sub pixel, a blue sub pixel, a white sub pixel.

The present invention further provides a display apparatus, comprising an image display device, wherein the image display device comprises:

an inputting module, employed for inputting original image data, wherein the original image data is employed to implement sharing pixel display on a display panel;

a converting module, employed for converting the original image data inputted by the inputting module into processed image data, wherein the processed image data is employed to implement independent pixel display on the display panel;

a compensating module, employed for implementing gray scale data compensation to pixel data in the processed image data according to a gray scale compensation table acquired by a compensation table acquiring unit; and a display module, employed for implementing display operation on the display panel with the processed image data after the gray scale data compensation;

wherein the compensating module further comprises:

a test gray scale acquiring unit, employed for acquiring test gray scale data under a plurality of various preset grey scales for pixel data of test image data, wherein the test image data is employed to implement independent pixel display on the display panel; and the compensation table acquiring unit, employed for acquiring the gray scale compensation table according to the test gray scale data and the preset gray scale data acquired by the test gray scale acquiring unit.

In the display apparatus of the present invention, the test gray scale acquiring unit is further employed for respectively acquiring test gray scale data under the same preset grey scale for each kind of pixel data of test image data.

In the display apparatus of the present invention, the compensating module further comprises:

a first gray scale data acquiring unit, employed for acquiring first gray scale data of pixel data in the processed image data;

gray scale compensation value acquiring unit, employed for acquiring gray scale compensation values corresponded with the first gray scale data acquired by the first gray scale data acquiring unit from the first gray scale data and the gray scale compensation table via a preset rule; and gray scale compensation value compensating unit, employed for implementing compensation to the first gray scale data of pixel data in the processed image data according to the gray scale compensation values acquired by the gray scale compensation value acquiring unit.

In the display apparatus of the present invention, the compensating module further comprises a storage unit, and the storage unit is employed for storing the gray scale compensation values corresponded with the first gray scale data after gray scale compensation value acquiring unit acquires gray scale compensation values corresponded with the first gray scale data.

In the display apparatus of the present invention, the pixel of the display panel comprises a red sub pixel, a green sub pixel, a blue sub pixel, a white sub pixel.

In the display apparatus of the present invention, the pixel of the display panel further comprises a yellow sub pixel.

The image display method, the image display device and the display apparatus of the present invention solves the issue of the uneven display of the panel with special pixel arrangement. Accordingly, the display effect is promoted.

DETAILED DESCRIPTION OF PREFERRED EMBODIMENTS

The word, "an embodiment" used in this specification means serving as an example, an instance, or an illustration. Besides, in this specification and the appended claims, the articles "a" generally means "one or more" unless specified otherwise or the singular form can be clearly confirmed in the context.

Figure 1:
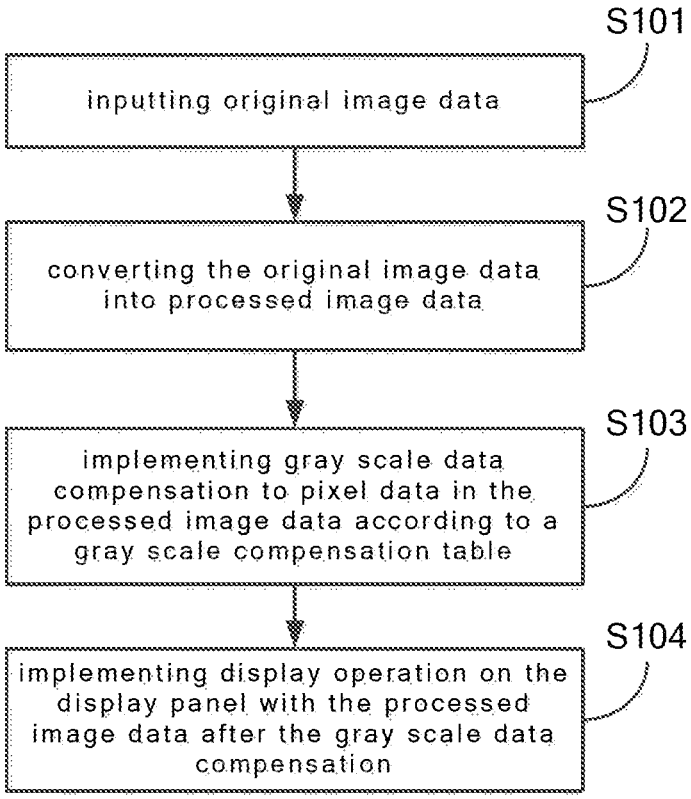
FIG. 1 is a flowchart of an image display method according to the first embodiment of the present invention.

Please refer to FIG. 1. FIG. 1 is a flowchart of an image display method according to the first embodiment of the present invention.

A shown in FIG. 1, the image display method of the embodiment comprises steps of:

S101, inputting original image data;

As sowing images on the display panel, the original image data is shown by sharing pixel display; i.e. the original image data can be shown on the display panel of particular pixel alignment (such as Pentile display panel). As such panel actually shows images, one pixel shares one sub pixel from the adjacent pixel to construct a basic pixel. Each basic pixel comprises a red sub pixel, a blue sub pixel, a green sub pixel. For instance, the blue sub pixel is lacked in one of the pixels, and the pixel will share the blue sub pixel in the adjacent pixel.

S102, converting the original image data into processed image data;

As sowing images on the display panel, the processed image data can be shown by independent pixel display; no pixel sharing phenomenon occurs to the processed image data in the display procedure. The original image data is converted into the processed image data according to the preset mapping relation. When the Pentile display panel is made, the mapping relation has been determined. Different Pentile display panels possess different mapping relations.

S103, implementing gray scale data compensation to pixel data in the processed image data according to a gray scale compensation table;

Before proceeding the step S103, the gray scale compensation table is acquired. Please refer to FIG. 2, the gray scale compensation table is specifically generated by steps of:

S201, acquiring test gray scale data under a plurality of various preset grey scales for pixel data of test image data;

The test image data can be generated with an internal image generator of the display panel, and the test image data can be shown by independent pixel display, i.e. no pixel sharing phenomenon occurs. The preset gray scale is the target gray scale. For instance, the gray scale threshold of the display panel is 0-255, and the preset gray scales are, such as 100, 200 and 254. As the preset gray scales are, such as 100, 200 and 254, the test image data having the foregoing gray scale values are shown on the display panel to acquire gray scale data (i.e. test gray scale data) for pixel data of test image data.

S202, acquiring the gray scale compensation table according to the test gray scale data and the preset gray scale data.

The gray scale compensation table is acquired with the test gray scale data and the preset gray scale data acquired in the step S201 via the preset functional relation. For instance, the operation of the preset functional relation is implemented to the test gray scale data and the preset gray scale data for the pixel data of the test image as the preset gray scale value is 100, and the gray scale compensation table of the preset gray scale is acquired. The gray scale compensation table can comprise a plurality of sets. Each of the gray scale compensation tables can be a table comprising the test gray scale data, the preset gray scale data and the gray scale compensation values.

S104, implementing display operation on the display panel with the processed image data after the gray scale data compensation;

The processed image data after the gray scale data compensation can be directly shown. Alternatively, the processed image data after the gray scale data compensation can be converted to be images capable of showing on the display panel having particular pixel alignment.

With the aforesaid process, the image data of pixel sharing shown on the Pentile display panel is converted to make the pixel sharing no longer exist in the image data on the Pentile display panel. Accordingly, as the uneven display occurs, it can be specifically confirmed which pixel is originated. Then, the gray scale compensation is implemented to the gray scale data for the pixel data of the image data without pixel sharing to solve the issue that the prior art cannot deal with when the uneven display occurs on the Pentile display panel and promote the display effect of the display panel. The aforesaid method is similarly applicable to the LCD (Liquid Crystal Display) and the OLED (Organic Light-Emitting Diode).

The image display method solve the issue that the prior art cannot deal the uneven display of the panel with special pixel arrangement. Accordingly, the display effect is promoted.

Figure 3:
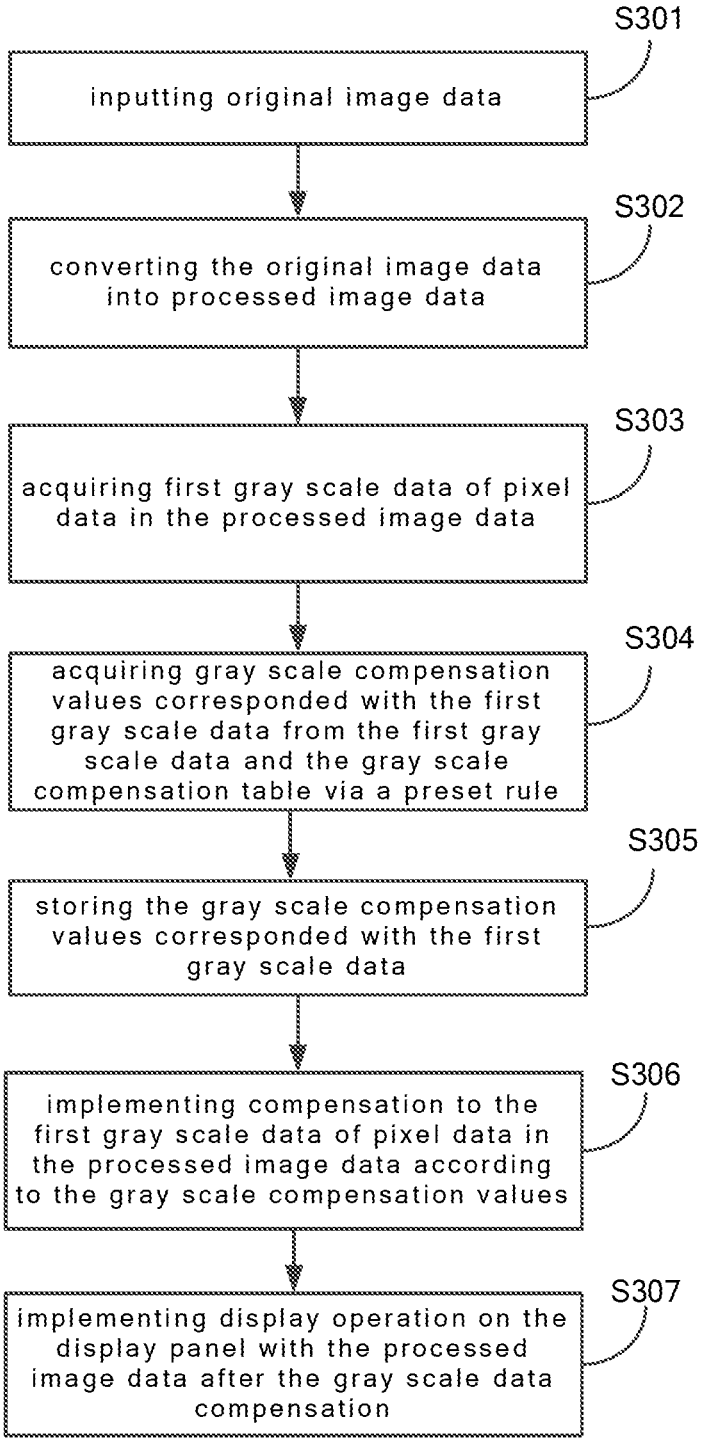
FIG. 3 is a flowchart of an image display method according to the second embodiment of the present invention.

Please refer to FIG. 3. FIG. 3 is a flowchart of an image display method according to the second embodiment of the present invention.

As shown in FIG. 3, the image display method of the embodiment comprises steps of:

S301, inputting original image data;

As sowing images on the display panel, the original image data is shown by sharing pixel display; i.e. the original image data can be shown on the display panel of particular pixel alignment (such as Pentile display panel). As such panel actually shows images, one pixel shares one sub pixel from the adjacent pixel to construct a basic pixel. Each basic pixel comprises a red sub pixel, a blue sub pixel, a green sub pixel. For instance, the blue sub pixel is lacked in one of the pixels, and the pixel will share the blue sub pixel in the adjacent pixel.

S302, converting the original image data into processed image data;

As sowing images on the display panel, the processed image data can be shown by independent pixel display; no pixel sharing phenomenon occurs to the processed image data in the display procedure. The original image data is converted into the processed image data according to the preset mapping relation. When the Pentile display panel is made, the mapping relation has been determined. Different Pentile display panels possess different mapping relations.

S303, acquiring first gray scale data of pixel data in the processed image data;

The processed image data comprises pixel data. After the step S302, the gray scale data (named as first gray scale data) of the pixel data in processed image data is acquired.

S304, acquiring gray scale compensation values corresponded with the first gray scale data from the first gray scale data and the gray scale compensation table via a preset rule;

After the step S303, the gray scale compensation table is acquired before the display panel leaves the factory. The display panels are different, and the gray scale compensation tables are different. The functional relation (preset rule) between the first gray scale data and the gray scale compensation table are set in advance. Therefore, the gray scale compensation values corresponded with the first gray scale data is acquired with the first gray scale data and the gray scale compensation table according to the preset rule. The preset rule can be, such as lookup, logic operation, et cetera. As an illustration, after the first gray scale data is looked up in the gray scale compensation table, the gray scale compensation values corresponded with the first gray scale data is acquired. Or, the logic operation is implemented to the first gray scale data and the preset gray scale data in the gray scale compensation table to acquired the gray scale compensation values corresponded with the first gray scale data. The gray scale compensation table comprises a first gray scale data, and gray scale compensation values corresponded with the first gray scale data as illustration.

S305, storing the gray scale compensation values corresponded with the first gray scale data.

After the step S304 of acquiring the gray scale compensation values corresponded with the first gray scale data, the gray scale compensation values corresponded with the first gray scale data is stored. When the display panel is inputted with the image data with the same gray scale value, the stored gray scale compensation values are directly used for implementing compensation to save the response time of the display panel.

S306, implementing compensation to the first gray scale data of pixel data in the processed image data according to the gray scale compensation values.

After the step S304 of acquiring the gray scale compensation values corresponded with the first gray scale data, the gray scale compensation values are used for implementing compensation to the first gray scale data of pixel data in the processed image data. Accordingly, the phenomenon of uneven display of the display panel can be eliminated.

Figure 2:
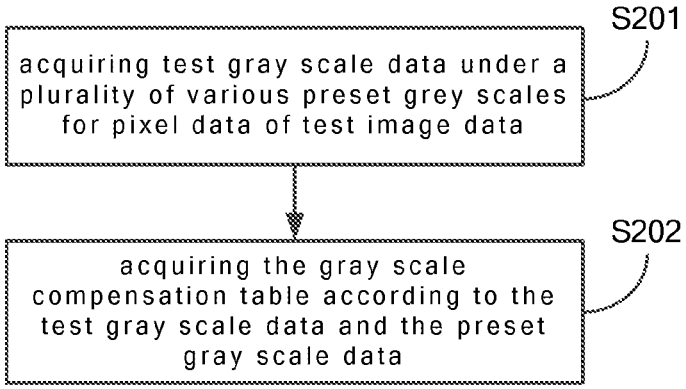
FIG. 2 is a detail flowchart of the third step in the image display method according to the first embodiment of the present invention.

Combining with FIG. 2, the gray scale compensation table in the step S304 is specifically generated by steps of:

S201, acquiring test gray scale data under a plurality of various preset grey scales for pixel data of test image data;

The test image data can be generated with an internal image generator of the display panel, and the test image data can be shown by independent pixel display, i.e. no pixel sharing phenomenon occurs. The preset gray scale is the target gray scale. For instance, the gray scale threshold of the display panel is 0-255, and the preset gray scales are, such as 100, 200 and 254. As the preset gray scales are, such as 100, 200 and 254, the test image data having the foregoing gray scale values are shown on the display panel to acquire gray scale data (i.e. test gray scale data) for pixel data of test image data.

Preferably, the step S201 can be realized by the following:

S2011, respectively acquiring test gray scale data under the same preset grey scale for each kind of pixel data of test image data;

The pixel data of the test image data comprises red, green, blue, and further can comprise white, yellow, et cetera; By setting a plurality of different preset gray scales, the test gray scale data under every preset grey scale for each kind of pixel data of test image data is acquired. For instance, the test gray scale data of pixel data of test image data when the gray scale value is 100 is acquired. That is, the test gray scale data of blue pixel data when the gray scale value is 100 is acquired, and the test gray scale data of red pixel data when the gray scale value is 100 is acquired, and the test gray scale data of green pixel data when the gray scale value is 100 is acquired.

By respectively acquiring the test gray scale data of each kind of pixel data, when the test image data is larger, the gray scale compensation table can be made against to each kind of pixel data. Accordingly, it can be prevented that the acquired gray scale compensation table is larger and the complexity of the operation increases to be beneficial for saving the storage space.

S202, acquiring the gray scale compensation table according to the test gray scale data and the preset gray scale data.

The gray scale compensation table is acquired with the test gray scale data and the preset gray scale data acquired in the step S201 via the preset functional relation. For instance, the operation of the preset functional relation is implemented to the test gray scale data and the preset gray scale data for the pixel data of the test image as the preset gray scale value is 100, and the gray scale compensation table of the preset gray scale is acquired. The gray scale compensation table can be a table comprising the test gray scale data, the preset gray scale data and the gray scale compensation values.

S104, implementing display operation on the display panel with the processed image data after the gray scale data compensation;

The processed image data after the gray scale data compensation can be directly shown. Alternatively, the processed image data after the gray scale data compensation can be converted to be images capable of showing on the display panel having particular pixel alignment.

The pixel of the display panel comprises a red sub pixel, a green sub pixel, a blue sub pixel, a white sub pixel. With the aforesaid process, the image data of pixel sharing shown on the Pentile display panel is converted to make the pixel sharing no longer exists in the image data on the Pentile display panel. Accordingly, as the uneven display occurs, it can be specifically confirmed which pixel is originated. Then, the gray scale compensation is implemented to the gray scale data for the pixel data of the image data without pixel sharing to solve the issue that the prior art cannot deal with when the uneven display occurs on the Pentile display panel and promote the display effect of the display panel. The aforesaid method is similarly applicable to the LCD (Liquid Crystal Display) and the OLED (Organic Light-Emitting Diode).

The image display method solve the issue that the prior art cannot deal the uneven display of the panel with special pixel arrangement. Accordingly, the display effect is promoted.

Figure 4:
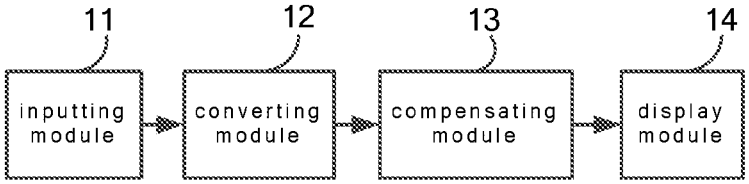
FIG. 4 is a structural diagram of an image display device according to the first embodiment of the present invention.

Please refer to FIG. 4. FIG. 4 is a structural diagram of an image display device according to the first embodiment of the present invention;

As shown in FIG. 4, the image display device of the embodiment comprises an inputting module 11, a converting module 12, a compensating module 13, a display module 14;

As sowing images on the display panel by the inputting module 11 to input the original image data, the original image data is shown by sharing pixel display; i.e. the original image data can be shown on the display panel of particular pixel alignment (such as Pentile display panel). As such panel actually shows images, one pixel shares one sub pixel from the adjacent pixel to construct a basic pixel. Each basic pixel comprises a red sub pixel, a blue sub pixel, a green sub pixel. For instance, the blue sub pixel is lacked in one of the pixels, and the pixel will share the blue sub pixel in the adjacent pixel.

As the converting module 12 converts the original image data inputted by the inputting module 11 into processed image data for sowing images on the display panel, the processed image data can be shown by independent pixel display; no pixel sharing phenomenon occurs to the processed image data in the display procedure. The converting module 12 converts the original image data into the processed image data according to the preset mapping relation. When the Pentile display panel is made, the mapping relation has been determined. Different Pentile display panels possess different mapping relations.

The compensating module 13 implements gray scale data compensation to pixel data in the processed image data according to a gray scale compensation table acquired by a compensation table acquiring unit 132.

Figure 5:
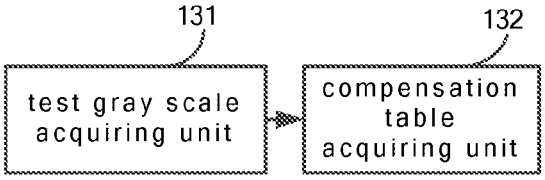
FIG. 5 is a structural diagram of the compensating module in the first embodiment of the present invention.

As shown in FIG. 5, the compensating module 13 comprises a test gray scale acquiring unit 131 and the compensation table acquiring unit 132.

The test gray scale acquiring unit 131 is employed for acquiring test gray scale data under a plurality of various preset grey scales for pixel data of test image data. The test image data can be generated with an internal image generator of the display panel, and the test image data can be shown by independent pixel display, i.e. no pixel sharing phenomenon occurs. The preset gray scale is the target gray scale. For instance, the gray scale threshold of the display panel is 0-255, and the preset gray scales are, such as 100, 200 and 254. As the preset gray scales are, such as 100, 200 and 254, the test image data having the foregoing gray scale values are shown on the display panel to acquire gray scale data (i.e. test gray scale data) for pixel data of test image data.

The compensation table acquiring unit 132 is employed for acquiring the gray scale compensation table according to the test gray scale data and the preset gray scale data acquired by the test gray scale acquiring unit 131.

The gray scale compensation table is acquired with the test gray scale data and the preset gray scale data via the preset functional relation. For instance, the operation of the preset functional relation is implemented to the test gray scale data and the preset gray scale data for the pixel data of the test image as the preset gray scale value is 100, and the gray scale compensation table of the preset gray scale is acquired.

The display module 14 implements display operation on the display panel with the processed image data after the gray scale data compensation by the compensating module 13.

The display module 14 can directly show the processed image data after the gray scale data compensation. Alternatively, the processed image data after the gray scale data compensation can be converted to be images capable of showing on the display panel having particular pixel alignment.

With the aforesaid process, the image data of pixel sharing shown on the Pentile display panel is converted to make the pixel sharing no longer exist in the image data on the Pentile display panel. Accordingly, as the uneven display occurs, it can be specifically confirmed which pixel is originated. Then, the gray scale compensation is implemented to the gray scale data for the pixel data of the image data without pixel sharing to solve the issue that the prior art cannot deal with when the uneven display occurs on the Pentile display panel and promote the display effect of the display panel. The aforesaid method is similarly applicable to the LCD (Liquid Crystal Display) and the OLED (Organic Light-Emitting Diode).

The image display method solve the issue that the prior art cannot deal the uneven display of the panel with special pixel arrangement. Accordingly, the display effect is promoted.

Figure 6:
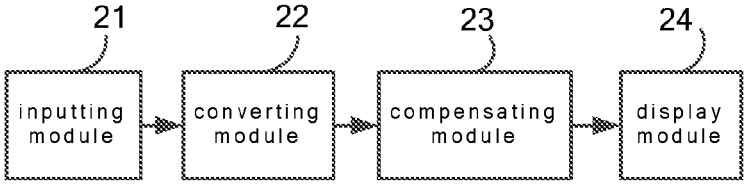
FIG. 6 is a structural diagram of an image display device according to the second embodiment of the present invention.

Please refer to FIG. 6. FIG. 6 is a structural diagram of an image display device according to the second embodiment of the present invention;

As shown in FIG. 6, the image display device of the embodiment comprises an inputting module 21, a converting module 22, a compensating module 23, a display module 24;

As sowing images on the display panel by the inputting module 21 to input the original image data, the original image data is shown by sharing pixel display; i.e. the original image data can be shown on the display panel of particular pixel alignment (such as Pentile display panel). As such panel actually shows images, one pixel shares one sub pixel from the adjacent pixel to construct a basic pixel. Each basic pixel comprises a red sub pixel, a blue sub pixel, a green sub pixel. For instance, the blue sub pixel is lacked in one of the pixels, and the pixel will share the blue sub pixel in the adjacent pixel.

As the converting module 22 converts the original image data inputted by the inputting module 21 into processed image data for sowing images on the display panel, the processed image data can be shown by independent pixel display; no pixel sharing phenomenon occurs to the processed image data in the display procedure. The converting module 22 converts the original image data into the processed image data according to the preset mapping relation. When the Pentile display panel is made, the mapping relation has been determined. Different Pentile display panels possess different mapping relations.

Figure 7:
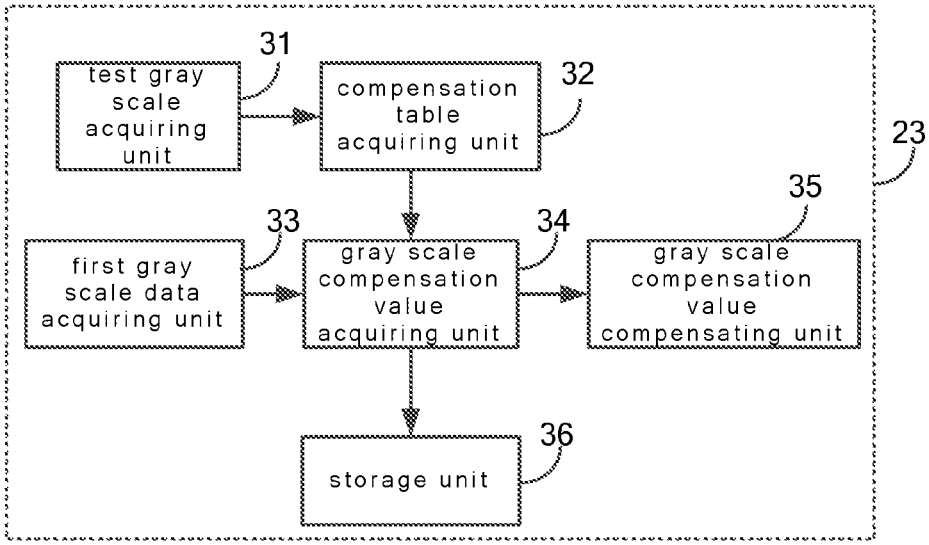
FIG. 7 is a structural diagram of the compensating module in the second embodiment of the present invention.

The compensating module 23 implements gray scale data compensation to pixel data in the processed image data according to a gray scale compensation table acquired by a compensation table acquiring unit 132;

In combination with FIG. 7, the compensating module 23 comprises a first gray scale data acquiring unit 33, a gray scale compensation value acquiring unit 34, a gray scale compensation value compensating unit 35, a storage unit 36.

The first gray scale data of the pixel data in the processed image data is acquired from the converting module 22 with the first gray scale data acquiring unit 33.

The processed image data comprises pixel data, and the gray scale data of the pixel data in acquired processed image data is named as first gray scale data.

The gray scale compensation value acquiring unit 34 implements logic operation to the first gray scale data and the gray scale compensation table acquired from the first gray scale data acquiring unit according to the preset rule to acquire the gray scale compensation values corresponded with the first gray scale data; the gray scale compensation table is acquired before the display panel leaves the factory. The display panels are different, and the gray scale compensation tables are different. The functional relation (preset rule) between the first gray scale data and the gray scale compensation table are set in advance. Therefore, the gray scale compensation values corresponded with the first gray scale data is acquired with the first gray scale data and the gray scale compensation table according to the preset rule. The preset rule can be, such as lookup, logic operation, et cetera. As an illustration, after the first gray scale data is looked up in the gray scale compensation table, the gray scale compensation values corresponded with the first gray scale data is acquired. Or, the logic operation is implemented to the first gray scale data and the preset gray scale data in the gray scale compensation table to acquire the gray scale compensation values corresponded with the first gray scale data. The gray scale compensation table comprises a first gray scale data, and gray scale compensation values corresponded with the first gray scale data as illustration.

After the gray scale compensation value acquiring unit 34 acquires the gray scale compensation values corresponded with the first gray scale data, the storage unit 36 stores the gray scale compensation values corresponded with the first gray scale data. When the display panel is inputted with the image data with the same gray scale value, the stored gray scale compensation values are directly used for implementing compensation to save the response time of the display panel.

The gray scale compensation value compensating unit 35 implements compensation to the first gray scale data of pixel data in the processed image data according to the gray scale compensation values acquired by the gray scale compensation value acquiring unit 34. After acquiring the gray scale compensation values corresponded with the first gray scale data, the gray scale compensation values are used for implementing compensation to the first gray scale data of pixel data in the processed image data. Accordingly, the phenomenon of uneven display of the display panel can be eliminated.

The compensating module further comprises a test gray scale acquiring unit 31 and a compensation table acquiring unit 32.

With the test gray scale data under a plurality of various preset grey scales for pixel data of test image data acquired by the test gray scale acquiring unit 131, the test image data can be generated with an internal image generator of the display panel, and the test image data can be shown by independent pixel display, i.e. no pixel sharing phenomenon occurs. The preset gray scale is the target gray scale. For instance, the gray scale threshold of the display panel is 0-255, and the preset gray scales are, such as 100, 200 and 254. As the preset gray scales are, such as 100, 200 and 254, the test image data having the foregoing gray scale values are shown on the display panel to acquire gray scale data (i.e. test gray scale data) for pixel data of test image data.

Preferably, the test gray scale acquiring unit 31 can respectively acquire test gray scale data under the same preset grey scale for each kind of pixel data of test image data.

The pixel data of the test image data comprises red, green, blue, and further can comprise white, yellow, et cetera; By setting a plurality of different preset gray scales, the test gray scale data under every preset grey scale for each kind of pixel data of test image data is acquired. For instance, the test gray scale data of pixel data of test image data when the gray scale value is 100 is acquired. That is, the test gray scale data of blue pixel data when the gray scale value is 100 is acquired, and the test gray scale data of red pixel data when the gray scale value is 100 is acquired, and the test gray scale data of green pixel data when the gray scale value is 100 is acquired.

By respectively acquiring the test gray scale data of each kind of pixel data, when the test image data is larger, the gray scale compensation table can be made against to each kind of pixel data. Accordingly, it can be prevented that the acquired gray scale compensation table is larger and the complexity of the operation increases to be beneficial for saving the storage space.

The compensation table acquiring unit 32 is employed for acquiring the gray scale compensation table according to the test gray scale data and the preset gray scale data acquired by the test gray scale acquiring unit 31.

The gray scale compensation table is acquired with the test gray scale data acquired by the test gray scale acquiring unit 31 and the preset gray scale data via the preset functional relation. For instance, the operation of the preset functional relation is implemented to the test gray scale data and the preset gray scale data for the pixel data of the test image as the preset gray scale value is 100, and the gray scale compensation table of the preset gray scale is acquired.

The display module 24 implements display operation on the display panel with the processed image data after the gray scale data compensation by the compensating module 23.

The display module 24 can directly show the processed image data after the gray scale data compensation. Alternatively, the processed image data after the gray scale data compensation can be converted to be images capable of showing on the display panel having particular pixel alignment.

The pixel of the display panel comprises a red sub pixel, a green sub pixel, a blue sub pixel, a white sub pixel. With the aforesaid process, the image data of pixel sharing shown on the Pentile display panel is converted to make the pixel sharing no longer exist in the image data on the Pentile display panel. Accordingly, as the uneven display occurs, it can be specifically confirmed which pixel is originated. Then, the gray scale compensation is implemented to the gray scale data for the pixel data of the image data without pixel sharing to solve the issue that the prior art cannot deal with when the uneven display occurs on the Pentile display panel and promote the display effect of the display panel. The aforesaid method is similarly applicable to the LCD (Liquid Crystal Display) and the OLED (Organic Light-Emitting Diode).

The image display method solve the issue that the prior art cannot deal the uneven display of the panel with special pixel arrangement. Accordingly, the display effect is promoted.

The present invention further provides a display apparatus, and the display apparatus can comprise any aforesaid image display devices, which have been disclosed above. The repeated description is omitted here.

In conclusion, above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An image display method, comprising:

inputting original image data, wherein the original image data is employed to implement sharing pixel display on a display panel having a plurality of pixels, and wherein a pixel of the plurality of pixels of the display panel comprises a red sub pixel, a green sub pixel, a blue sub pixel, a white sub pixel, wherein in the sharing pixel display, the pixel shares one of the red sub-pixel, the green sub-pixel and the blue sub-pixel with an adjacent pixel;

converting the original image data into processed image data, wherein the processed image data is employed to implement independent pixel display on the display panel, wherein in the independent pixel display, the pixel shares none of the red sub-pixel, the green sub-pixel and the blue sub-pixel with any adjacent pixel;

implementing gray scale data compensation to pixel data in the processed image data according to a gray scale compensation table; and implementing display operation on the display panel with the processed image data after the gray scale data compensation, wherein the gray scale data compensation table is generated by steps of:

acquiring test gray scale data under a plurality of various preset grey scales for pixel data of test image data, and respectively acquiring test gray scale data under the same preset grey scale for each kind of pixel data of test image data, wherein the test image data is employed to implement independent pixel display on the display panel; and acquiring the gray scale compensation table according to the test gray scale data and the preset gray scale data.

2. The image display method according to claim 1, wherein the step of implementing gray scale data compensation to pixel data in the processed image data according to a gray scale compensation table comprises:

acquiring first gray scale data of pixel data in the processed image data;

acquiring gray scale compensation values corresponding to the first gray scale data from the first gray scale data and the gray scale compensation table via a preset rule; and implementing compensation to the first gray scale data of pixel data in the processed image data according to the gray scale compensation values.

3. The image display method according to claim 2, wherein after the step of acquiring the gray scale compensation values corresponding to the first gray scale data, the method further comprises: storing the gray scale compensation values corresponding to the first gray scale data.

4. The image display method according to claim 1, wherein the pixel of the display panel further comprises a yellow sub pixel.

* * * * *